US011659917B2

(12) United States Patent
Shaw et al.

(10) Patent No.: US 11,659,917 B2
(45) **Date of Patent: *May 30, 2023**

(54) APPARATUS WITH SELF-RETRACTING ELASTOMERIC SUPPORT BAND

(71) Applicant: Steven E. Shaw, Prosper, TX (US)

(72) Inventors: Thomas J. Shaw, Frisco, TX (US); Steven E. Shaw, Prosper, TX (US); Mark Small, Heavener, OK (US)

(73) Assignee: SLINGER, LLC, Preston, TX (US)

( * ) Notice: Subject to any disclaimer, the term of this patent is extended or adjusted under 35 U.S.C. 154(b) by 37 days.

This patent is subject to a terminal disclaimer.

(21) Appl. No.: 17/825,479

(22) Filed: May 26, 2022

(65) Prior Publication Data

US 2022/0279915 A1 Sep. 8, 2022

Related U.S. Application Data

(63) Continuation of application No. 17/116,156, filed on Dec. 9, 2020, now Pat. No. 11,388,979.

(51) Int. Cl.
*A45F 5/00* (2006.01)
*A45C 11/00* (2006.01)

(52) U.S. Cl.
CPC ..... *A45F 5/004* (2013.01); *A45C 11/00* (2013.01); *A45C 2011/002* (2013.01); *A45F 2005/006* (2013.01); *A45F 2200/0516* (2013.01)

(58) Field of Classification Search
CPC ..... A45F 5/004; A45F 2005/006; A45F 2200/0508; A45F 2200/0516; A45F 2200/0525; A45F 2003/142; A45C 11/00; A45C 2011/002; A45C 13/30; A45C 13/26; A45C 2011/001; F16M 13/00; Y10S 224/93; B65H 75/368; B65H 75/4428
USPC ..... 224/162
See application file for complete search history.

(56) References Cited

U.S. PATENT DOCUMENTS

| | | | | |
|---|---|---|---|---|
| 5,331,721 | A | 7/1994 | Raum, Sr. | |
| 5,794,881 | A * | 8/1998 | Evans | F16F 1/123 242/375 |
| 6,874,722 | B2 | 4/2005 | Wei | |
| 8,408,513 | B2 | 4/2013 | Smith | |
| 8,915,409 | B2 | 12/2014 | Smith | |
| 10,143,295 | B2 | 12/2018 | Palma | |
| 10,171,639 | B2 | 1/2019 | Hu et al. | |

(Continued)

*Primary Examiner* — Adam J Waggenspack
(74) *Attorney, Agent, or Firm* — Stamoulis & Weinblatt LLC

(57) ABSTRACT

Apparatus selectively attachable to the outer case of a cellular telephone or other similarly sized portable device. The apparatus desirably includes a housing containing an elastomeric band that is principally disposed inside the housing when the apparatus is not in use. When the apparatus of the invention is attached to the outer case of a cell phone, a portion of the elastomeric band is manually withdrawn through an opening in the housing and can be releasably latched in place to form a flexible, continuous loop outside the housing. The flexible, continuous loop can be used as a selectively retractable carrying strap when the cell phone or other similar device is not in use. Alternatively, the flexible continuous loop can be used, for example, to support the cell phone around a user's neck for hands-free use when the user is engaged in other activities.

16 Claims, 6 Drawing Sheets

(56) References Cited

U.S. PATENT DOCUMENTS

| | | | |
|---|---|---|---|
| 11,026,502 | B1 | 6/2021 | Erold |
| 2008/0035778 | A1 | 2/2008 | Belden et al. |
| 2010/0206922 | A1 | 8/2010 | Gross et al. |
| 2014/0198442 | A1 | 7/2014 | Rekuc et al. |
| 2015/0342324 | A1 | 12/2015 | Zhao |
| 2016/0094262 | A1 | 3/2016 | Chorny |

* cited by examiner

APPARATUS WITH SELF-RETRACTING ELASTOMERIC SUPPORT BAND

This application is a continuation of U.S. application Ser. No. 17/116,156, filed on Dec. 9, 2020, which is incorporated herein in its entirety.

FIELD OF THE INVENTION

This invention relates to an apparatus that is selectively attachable to the outer case of a cellular telephone ("cell phone") or other similarly portable device. The apparatus desirably includes a housing containing an elastomeric band, belt or strap that is principally disposed inside the housing when the apparatus is not in use. When the apparatus of the invention is attached to the outer case of a cell phone or other device, a portion of the elastomeric band, belt or strap can be selectively withdrawn from the housing and can be releasably latched or locked in place to form a flexible, continuous loop. The flexible continuous loop can be used, for example, to support the cell phone around a user's neck for hands-free use when the user is engaged in other activities. Alternatively, the flexible, continuous loop can be used as a selectively retractable carrying strap when the cell phone or other device is not in use.

DESCRIPTION OF RELATED ART

Cell phones are most often carried in a hand, pocket or bag of a mobile user. When the user is driving a motor vehicle, the cell phone is sometimes placed in a support frame or cradle mounted on or suspended from the dashboard, mirror or console while the user utilizes a speaker phone or a "Bluetooth" connection to carry on a telephone conversation with another person. Unfortunately for the safety of a user and for other surrounding motorists, cell phones are more often held unsafely in one hand of a driver while grasping a steering wheel in the other hand.

Purses and shoulder bags comprising straps with buckles for adjusting strap length are also known and worn over the shoulder and/or around the neck of a user. More recently, purses and other small personal utility bags supported by conventional carrying straps have been disclosed and advertised that also comprise an outwardly facing pocket or compartment into which a cell phone can be inserted for convenient viewing through a transparent plastic "window."

Other prior devices commonly referred to as "measuring tapes" are made of housings containing a coiled strip of flexible metal with measuring indicia marked on it. Such devices typically comprise spring-powered retraction mechanisms that add weight, complexity and expense to the products with which they are used and take up additional space without providing commensurate additional utility that are retractable into a housing following use.

SUMMARY OF THE INVENTION

An apparatus is disclosed here that is durable, safe and conveniently usable for supporting and selectively maintaining a cell phone or other similarly portable device in a readily available and usable position proximal to a mobile user engaged in activities such as, for example, driving, bicycling, hiking, walking, fishing, grocery shopping, cleaning, performing vehicular or home maintenance chores, and the like.

The apparatus of the invention is desirably usable as an ancillary aftermarket attachment to cell phones of various brands, models and sizes. If preferred, the subject apparatus can also be incorporated into a telephone case as an option from an original equipment manufacturer ("OEM") or into a protective case such as those marketed under the trademarks "OTTER Body" or "mophie" that offer additional durability or battery life to aftermarket consumers. Also, it will be appreciated upon reading this disclosure in relation to the accompanying drawings that although the subject invention is primarily intended for use with cell phones, it can be similarly useful with other portable devices such as, for example, cameras, radios, remote communications equipment, measurement or testing instruments, and the like.

One satisfactory embodiment of an apparatus of the invention desirably includes a housing containing an elastomeric band, belt or strap that is principally disposed inside the housing when the apparatus is not in use. When the apparatus of the invention is attached to the outer case of a cell phone, a portion of an elastomeric band, belt or strap (hereinafter referred to as an "elastomeric band" for brevity) is anchored inside the housing and is desirably graspable through an opening in the housing and manually drawn through the opening to form a flexible loop of desired size. The elastomeric band is then releasably latched in place by a plurality of rotatable latches mounted in the housing. The flexible, continuous loop can be used, for example, to support the cell phone around a user's neck for hands-free use when the user is engaged in other activities. Alternatively, the loop can be used as a selectively retractable carrying strap when the cell phone or other similar device is not in use. Depending upon the size of the loop, it can also be used to hang a cell phone or other portable device from an auto mirror or hook for other hands-free use.

The apparatus of the invention comprises an array of wheels or pulleys rotatably mounted inside the housing that are positioned to engage, support and facilitate stretching of the elastomeric band. In a preferred embodiment the elastomeric band is configured as a long flexible trip having opposed ends that each comprise a small loop anchored at a particular point inside the housing. The length and elasticity of the elastomeric band are desirably such that the band is self-retractable so that it resides entirely inside the housing when in a relaxed, unlocked position. When a graspable portion of the band is pulled outwardly from the housing, it can be locked in a fixed position relative to the housing by manually rotating two frictionally engageable, rotatable latches disposed adjacent to the opening. In one embodiment of the invention, the rotatable latches are cooperatively configured to self-engage and hold a loop of desired size external to the housing when outwardly directed pressure on the elastomeric band is relaxed. In this way the user can maintain the housing and the portable device to which it is attached in a desired position relative to the user. Alternatively, if for example the user is wearing the apparatus around her or his neck and desires to increase or decrease the size of the loop, the relatively positioning of the apparatus can be adjusted by withdrawing a longer length of elastomeric band through the opening of the housing or by selectively releasing the latches to allow some of the band to self-retract inside the housing as desired.

The latches used in the apparatus of the invention can be configured to be manually engageable at any time to fix the position of the elastomeric band relative to the housing or can be configured to frictionally lock down on the band only when the band is allowed to relax and begins to self-retract back inside the housing. The length and elasticity of the band are desirably such that it can be stretched outside the housing to form an external loop of desired dimensions and yet self-retract fully inside the housing when allowed to relax with the latches selectively disengaged from the band.

BRIEF DESCRIPTION OF THE DRAWINGS

The apparatus of the invention is further described and explained in relation to the following drawings wherein.

The reader should understand that like numbers are generally used to designate like parts in the accompanying drawing figures but that the figures are not drawn to scale.

DESCRIPTION OF THE PREFERRED EMBODIMENTS

Figure 1:
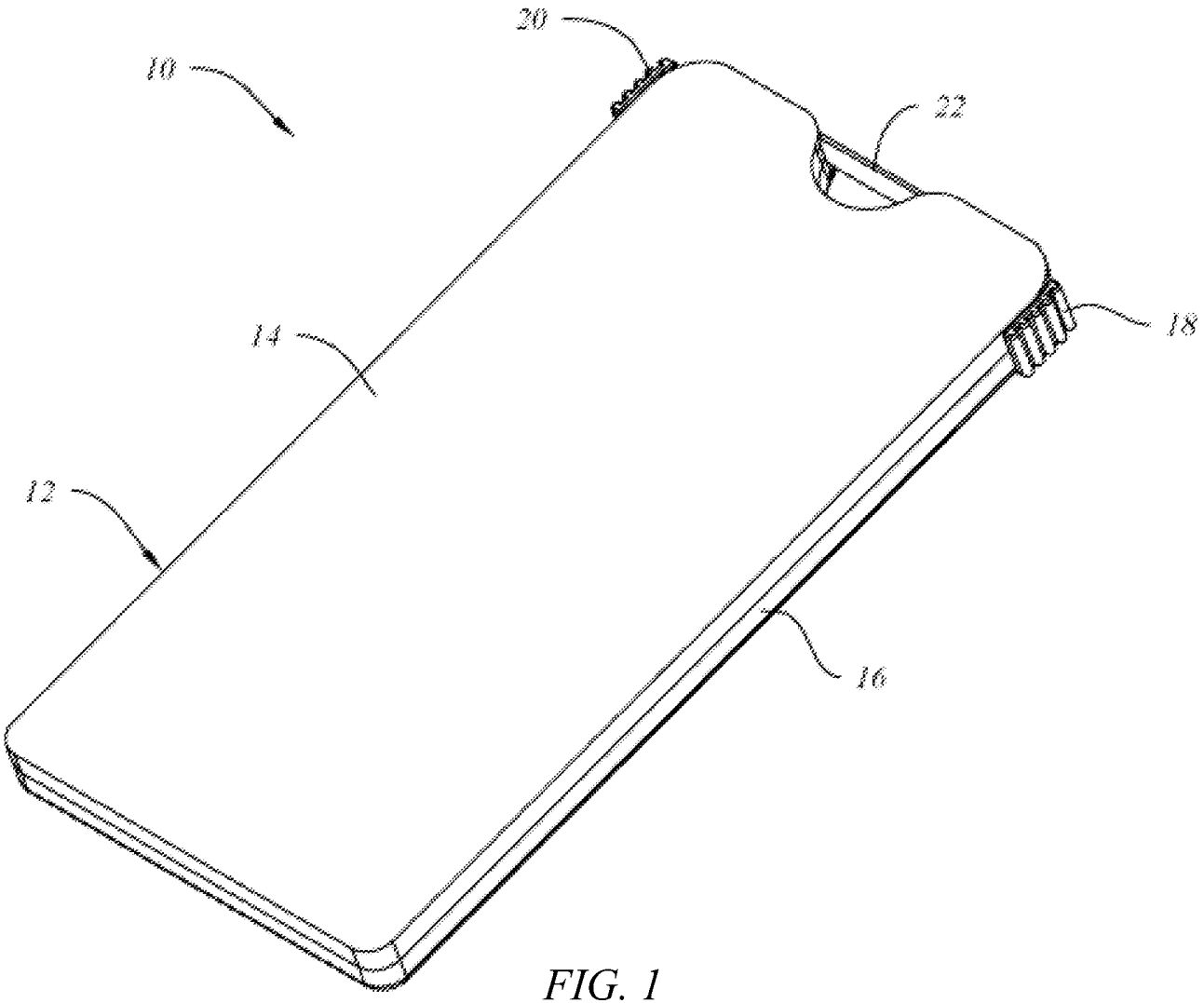
FIG. 1 is a rear perspective view of one embodiment of the apparatus of the invention with an elastomeric belt fully retracted into the housing except for a small portion that spans an opening in the housing and is manually accessible through the opening.
Figure 7:
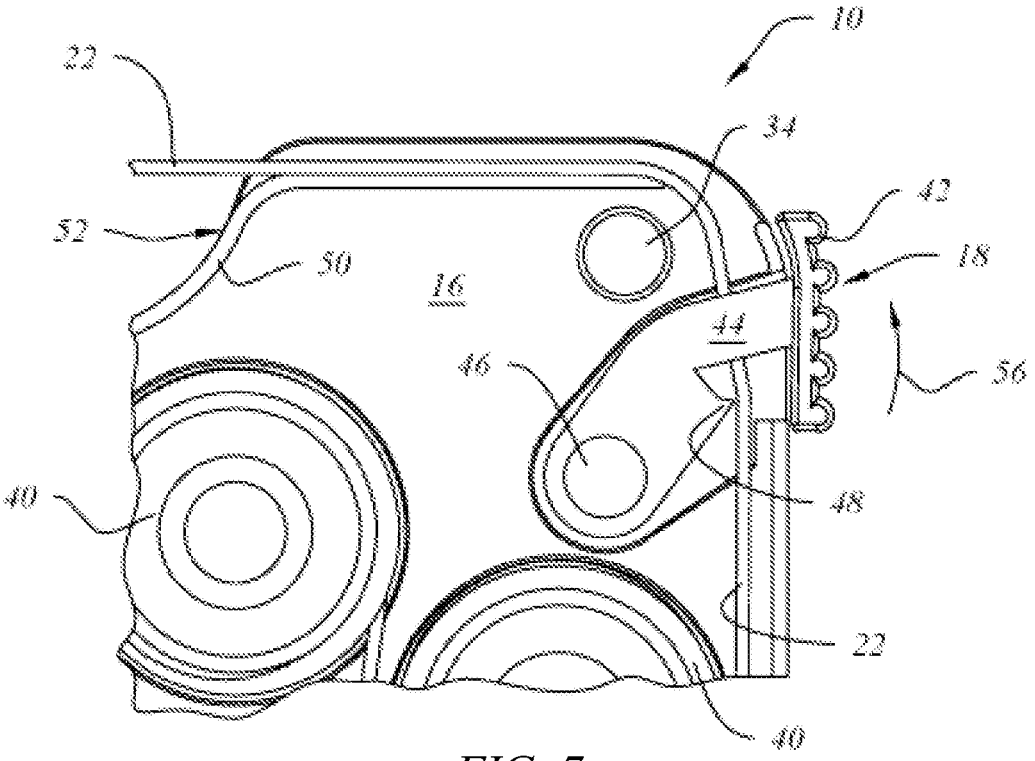
FIG. 7 is an enlarged detail rear elevation view of the apparatus of FIG. 1 shown substantially as in FIG. 8 with the rotatable latches rotated to an unlocked position to allow the elastomeric belt to contract inside the housing while still maintaining slight tension in an accessible portion of the elastic band that spans an opening in the housing to avoid having slack in the elastomeric belt when retracted.
Figure 8:
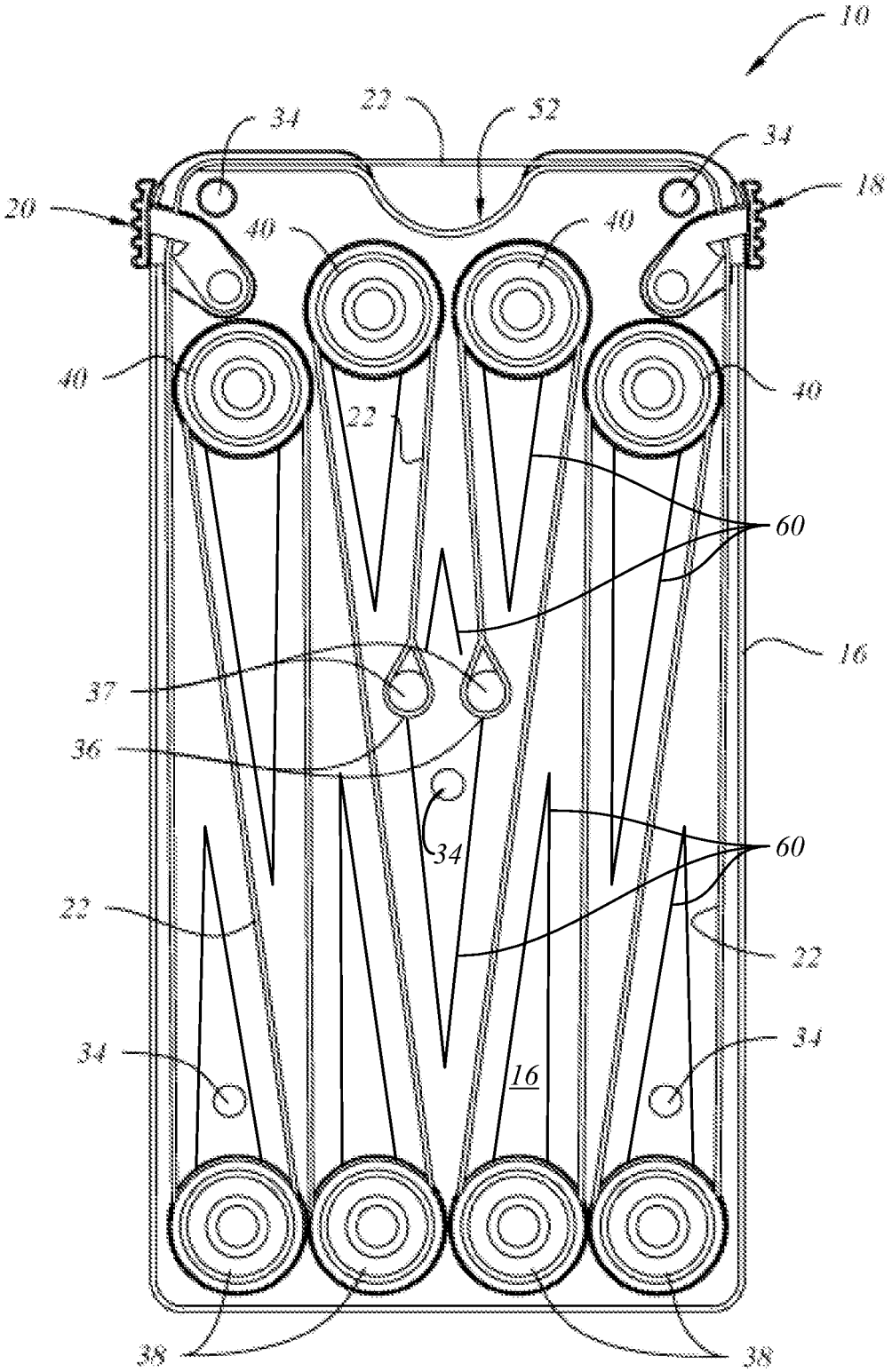
FIG. 8 is an enlarged detail rear elevation view of the apparatus of FIG. 1 with the rear cover of the housing removed and the rotatable latches positioned in an unlocked position to allow the elastic band to contract to the greatest extent permitted inside the housing while still maintaining slight tension in the portion of the elastic band disposed inside the housing to avoid having slack in the elastic band.

Referring to FIGS. 1, 7 and 8, apparatus 10 comprises housing 12 further comprising body 16 with selectively removable cover 14, opposing latches 18, 20 and an elastomeric band 22 disposed inside housing 12, with a portion of elastomeric band 22 being visible and graspable through recessed opening 52 cooperatively formed in cover 14 and body 16. Housing 12 of apparatus 10 is desirably formed from a moldable polymeric material such as, for example, high impact polystyrene or another similarly suitable material. Elastomeric band 22 is desirably disposed entirely inside housing 12 (except for the portion of elastomeric band 22 that is visible and graspable 12 when latches 18, 20 are in an unlocked position and elastomeric band 22 is relaxed sufficiently to self-retract into housing 12).

Figure 3:
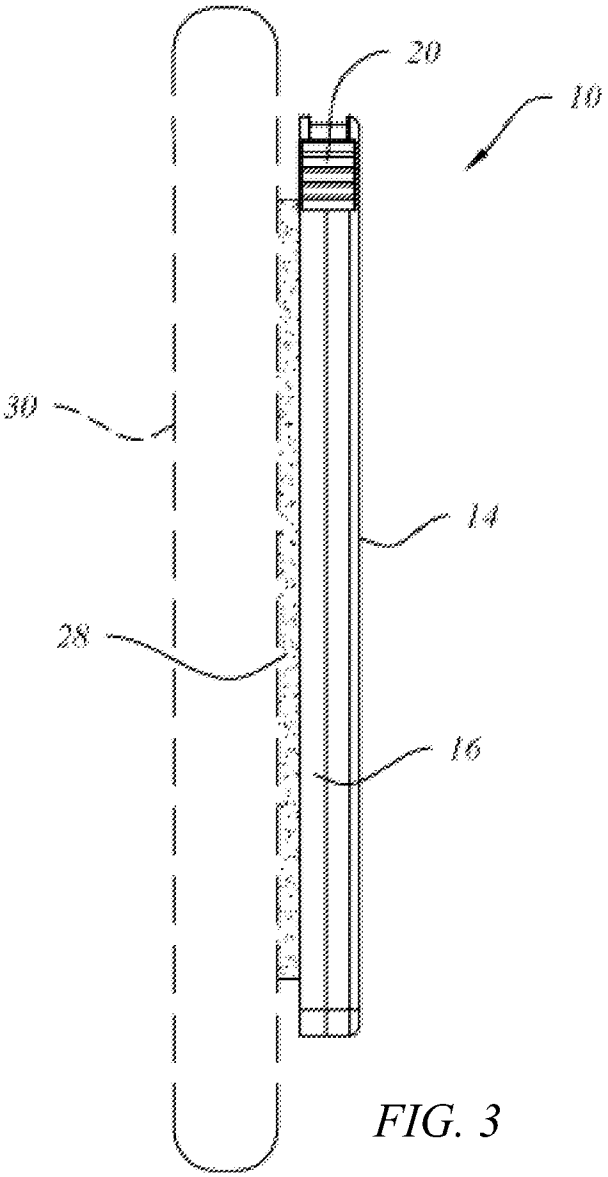
FIG. 3 is a right-side elevation view of the embodiment of FIG. 2 with the cover sheet of FIG. 2 removed from the adhesive pad and the adhesive pad adhered to the rearwardly facing surface of a cell phone shown in dashed outline.
Figure 2:
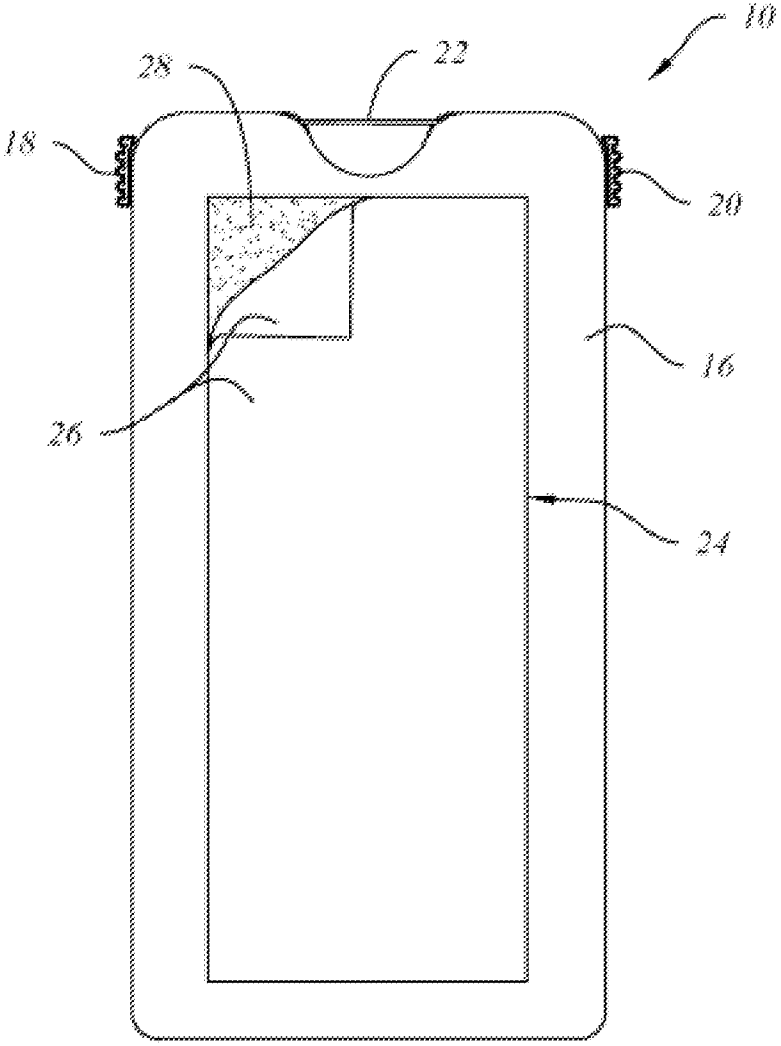
FIG. 2 is a front elevation view of the embodiment of the apparatus of FIG. 1 with a pressure-sensitive adhesive pad adhered to the front cover of the housing and having a peel-away cover sheet partially removed from the adhesive pad.

Referring to FIGS. 2 and 3, apparatus 10 is desirably attachable to a portable device such as a cellular telephone 30 (not part of the invention except when the other functional portions of apparatus 10 are incorporated into a body 14 that forms part of the portable device) using an adhesive pad 28 or other similarly effective attachment means permitting use of apparatus 10 as an aftermarket attachment to cellular telephone 30. Adhesive pad 28 of a size satisfactory for this purpose are typically commercially available and provided with a peel-off cover sheet 26 on each side that is removable to expose oppositely facing adhesive surfaces suitable for use in securing body 16 of housing 12 to the back surface of a device such as cellular telephone 20 with which it is intended to be used. When apparatus 10 is ready for use when configured as shown in FIG. 3, with latches 18 and 20 unlatched and elastomeric band 22 disposed in a visible and graspable position but is otherwise fully retracted inside housing 12 (FIG. 1).

Figure 4:
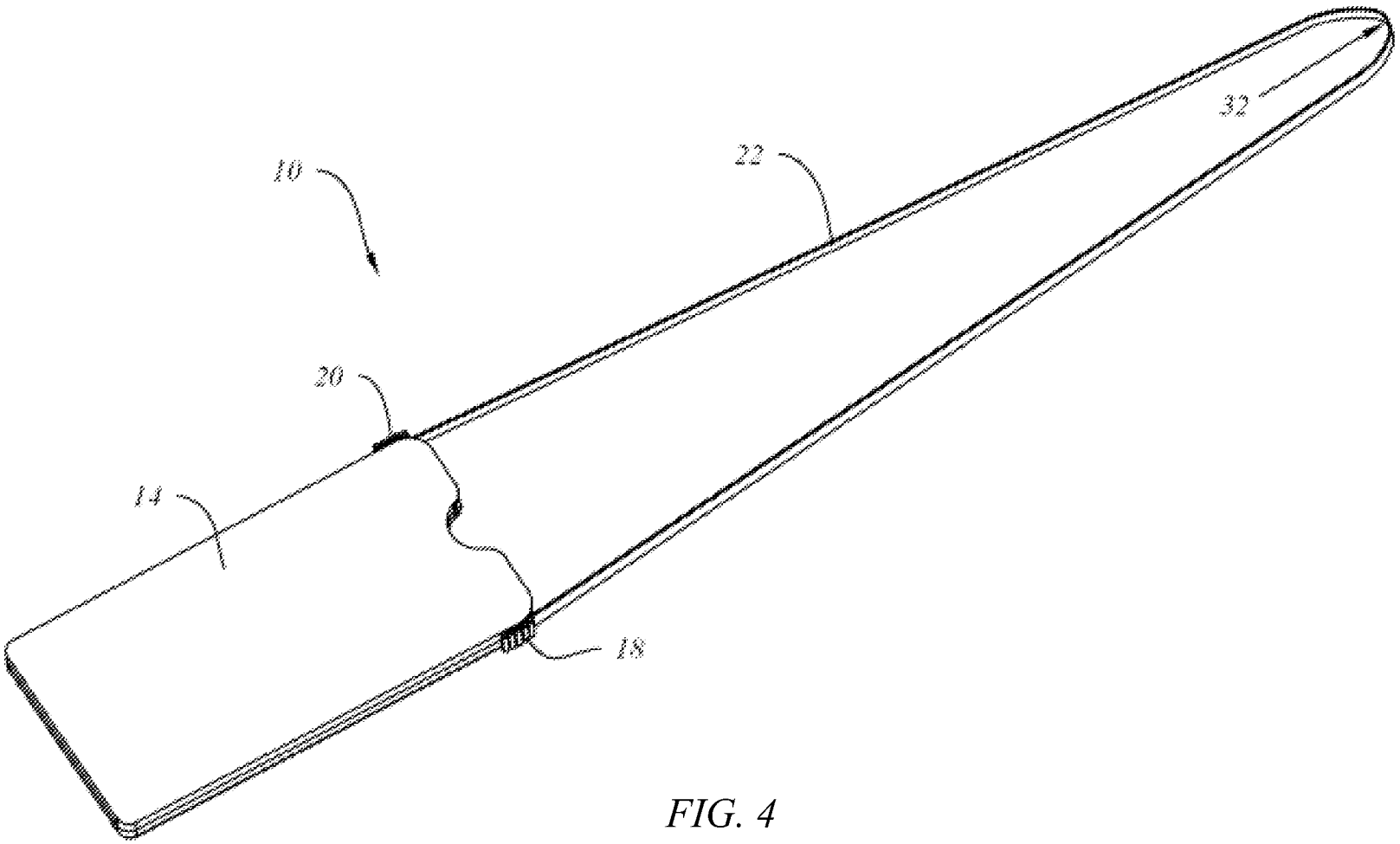
FIG. 4 is a rear perspective view of the apparatus as in FIG. 1 with the elastomeric belt extended outside the housing through an opening in the housing.

Referring to FIG. 4, apparatus 10 is shown with a portion of elastomeric band 22 pulled outwardly away from cover 14 to form a flexible elongated loop of desired size when a force 32 is exerted against the outermost portion of elastomeric band 22 relative to the other portions of apparatus 10. During the expansion of elastomeric band 22 as shown in FIG. 4, latches 18 and 20 are desirably positioned to permit outwardly directed movement of elastomeric band relative to cover 14. When elastomeric band 22 is stretched outwardly to a desired extent, latches 18 or 20 can be manually engaged by the user to prevent self-retraction of elastomeric band 22 back inside apparatus 10. Latches 18, 20 can be configured to be manually engageable and releasable or, alternatively, to automatically engage by rotating to create frictional contact between elastomeric band 22 and body 16 of apparatus 10 when force 32 (FIG. 4) is relaxed and elastic band is permitted to self-retract.

Figure 5:
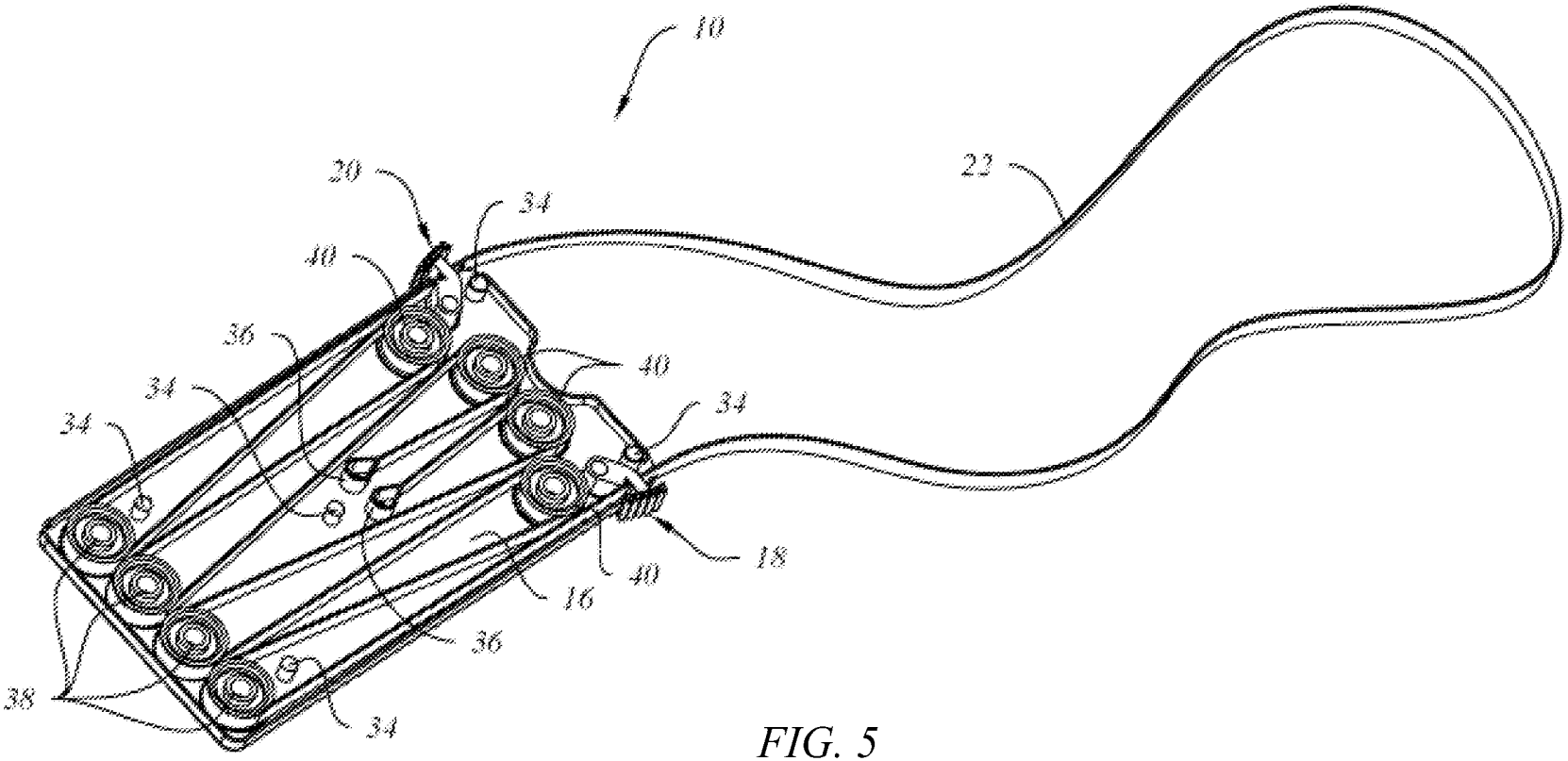
FIG. 5 is a rear perspective view as in FIG. 4 with the rear cover of the housing removed and rotatable latches positioned to hold the elastomeric belt in the fully extended position relative to the housing, thereby allowing the portion of the elastomeric belt extending outwardly from the housing to relax from the fully extended position.

Referring to FIGS. 5-8, apparatus 10 is depicted with cover 14 (FIG. 4) removed to reveal the inside of housing 12 (FIG. 1) as seen looking into body 16. Body 16 preferably further comprises a plurality of rotatable wheels or pulleys (hereafter "pulleys") 40 around which elastomeric band 22 is positioned for use. Referring to FIGS. 5 and 8, in this embodiment of the invention, each of two opposed ends of elastomeric band 22 comprises a loop 36 that is disposed over one of two spaced-apart anchor posts 37 and then wrapped circuitously around pulleys 40, with the centrally disposed portion of elastomeric band 22 passing between latches 18, 20 and inside wall of body 16, around guide wall 50 (best visible in FIGS. 6 and 7), and across recessed opening 52. A plurality of spaced-apart sites 34 are disposed inside body 16 that are desirably coaxially aligned with corresponding sites on the underside of cover 14 (FIG. 1) that cooperate provide structural support to body 16 and frictional engagement with the underside of cover 14 (FIG. 1). Sites 34 can be used to position posts that are frictionally engageable, for example, with opposed receptacles disposed under cover 14 to provide "snap-fit" frictional engagement between cover 14 and body 16. Alternatively, other selectively releasable attachment means such as screws and cooperatively aligned threaded receptacles can be used to attach cover 14 to body 16 of apparatus 10. Additionally, in another alternative embodiment of the invention described but not depicted in relation to FIG. 8, a plurality of spacers (preferably wedge-shaped guides) can be provided in the triangularly shaped spaces formed between the two oppositely disposed sets of pulleys 40 inside body 16 to avoid tangling of portions of elastomeric band 22 inside housing 12 (FIG. 1) during a sudden release and relaxation of elastomeric band 22 from the position shown in FIG. 5 to the position shown in FIG. 8.

Figure 6:
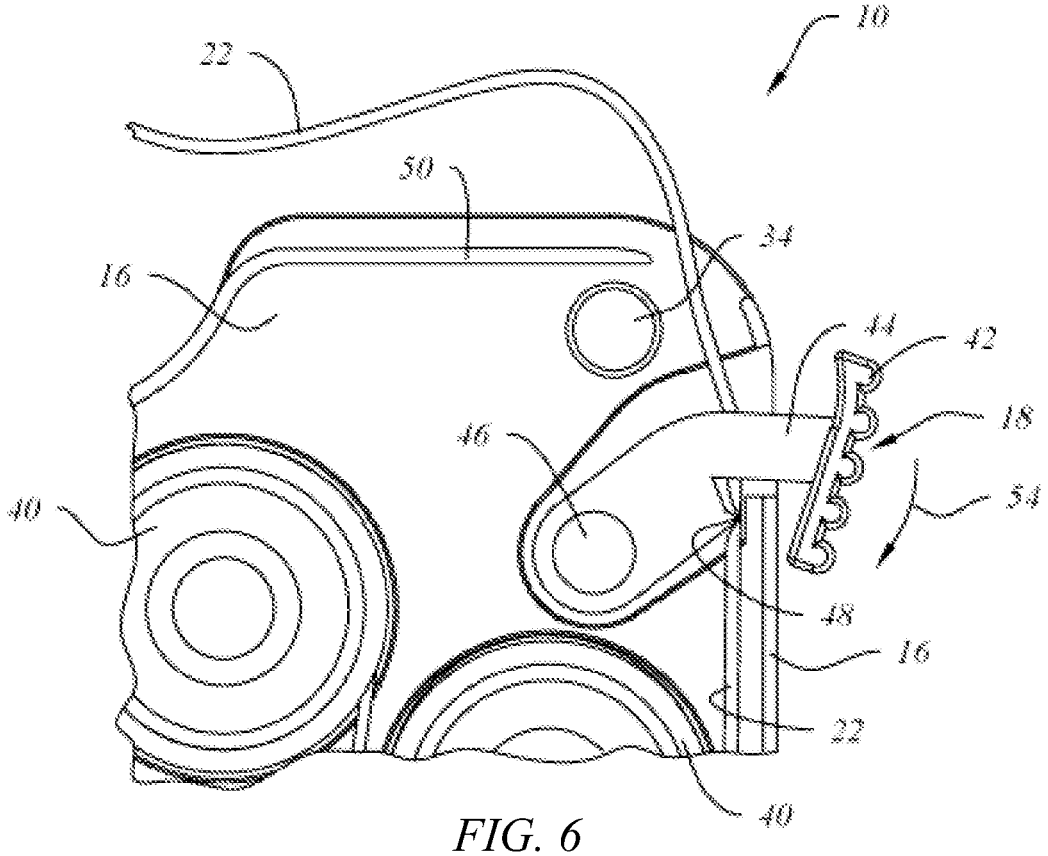
FIG. 6 is an enlarged detail rear elevation view of the apparatus of FIG. 1 shown substantially as in FIG. 5 with the rear cover of the housing removed and the rotatable latches rotated to a locked positioned to hold the portion of the elastomeric belt disposed inside the housing in an extended position and under tension inside the housing while allowing a portion of the elastomeric belt disposed outside the housing to remain in a comparatively more relaxed position that is not under tension outwardly of the latches.

Referring to FIGS. 6-8, rotatable latches 18, 20 are desirably used to provide selectively releasable frictional engagement between elastomeric band 22 and inside wall of body 16. Referring to FIG. 6, latch 18 with touch surface 42, lever arm 44 and pivot post 46 is shown in a "latched" position with lateral projection 48 "pinching" a portion of elastomeric band 22 against body 16 after rotating latch 18 downwardly by the application of manual pressure to touch surface 42 of latch 18 as indicated by arrow 54. Conversely, referring to FIG. 7, latch 18 is shown in an "unlatched position" with lateral projection 48 rotated upwardly as indicated by arrow 56 to release the adjacent portion of elastomeric band 22 from frictional engagement with body 16 to thereby permit self-retraction of elastomeric band 22 back inside housing 12 as shown in FIG. 1.

Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventor and/or Applicant are legally entitled.

What is claimed is:

1. An apparatus useful for suspending a portable device from a body portion of a user or other support structure, the apparatus comprising:

a housing with a mutually engageable cover and a body, the body being attachable to a cell phone or to a protective case or cover for a cell phone or another portable device;

a flexible elastomeric band disposed inside the housing, the band being accessible through an opening in the housing and having sufficient elasticity and durability to be manually stretchable outwardly through an opening in the housing for a distance sufficient to form a flexible support loop;

an array of rotatable pulleys disposed in spaced-apart relation inside the housing, with each rotatable pulley having a periphery contacting and frictionally engaging the elastomeric band to support the elastomeric band in tension when a portion of the elastomeric band is stretched outwardly through the opening in the housing; and wherein the elastomeric band is anchored inside the housing and then wrapped circuitously around the array of rotatable pulleys and a plurality of triangularly shaped spaces are formed between two oppositely disposed sets of pulleys inside the body.

2. The apparatus of claim 1 wherein the elastomeric band has an unstretched length and elasticity selected in cooperation with the rotatable pulleys in the array to sequentially allow the elastomeric belt to be manually stretched when at least one selectively releasable latch is selectively operated to facilitate extension of the elastomeric band relative to the housing.

3. The apparatus of claim 2 wherein the elastomeric hand has an unstretched length and elasticity selected in cooperation with the number, size and placement of rotatable pulleys in the array to sequentially allow the flexible support loop of the elastomeric band to contract back inside the housing when the at least one selectively releasable latch is selectively operated to facilitate contraction of the elastomeric band relative to the housing.

4. The apparatus of claim 1 wherein the elastomeric band has first and second ends anchored inside the housing at two separate anchor points disposed substantially in the center of the body.

5. The apparatus of claim 1 including plurality of sites are disposed inside the body that are coaxially aligned with corresponding sites on an underside of the cover.

6. The apparatus of claim 1 wherein at least the front of the housing is attached to a cell phone or to a protective case for a cell phone by a pad treated with a pressure-sensitive adhesive that is applied to facing surfaces of the apparatus and one of the cell phone or protective case for a cell phone.

7. The apparatus of claim 1 comprising two opposed, spaced-apart latches each connected to a part of the housing.

8. The apparatus of claim 1 wherein the housing and pulleys comprise a moldable polymeric material.

9. The apparatus of claim 1, wherein the number of pulleys is at least eight.

10. The apparatus of claim 1, wherein the portable device is a cell phone.

11. The apparatus of claim 1, wherein the at least one selectively releasable latch is manually engageable and releasable.

12. The apparatus of claim 1, wherein the at least one selectively releasable latch is automatically engaged by rotating to create frictional contact between the elastomeric band and body when a force is relaxed and the elastomeric band is permitted to self-retract.

13. The apparatus of claim 1, wherein a plurality of spacers are provided in the plurality of triangularly shaped spaces.

14. The apparatus of claim 1, where the cover is releasably attached to the body.

15. The apparatus of claim 1 wherein the spacers are wedged-shaped guides.

16. The apparatus of claim 1, further comprising at least one selectively releasable latch.

* * * * *